United States Patent [19]

Pryor et al.

[11] Patent Number: 4,807,809

[45] Date of Patent: Feb. 28, 1989

[54] ROD MAKING APPARATUS FOR SMOKING ARTICLE MANUFACTURE

[75] Inventors: James W. Pryor, Winston-Salem; John L. Nelson, Lewisville; Clifford R. Marritt, Winston-Salem, all of N.C.

[73] Assignee: R. J. Reynolds Tobacco Company, Winston-Salem, N.C.

[21] Appl. No.: 156,502

[22] Filed: Feb. 12, 1988

[51] Int. Cl.[4] ..... A24C 5/18

[52] U.S. Cl. ..... 131/84.1; 493/42; 131/339; 131/340

[58] Field of Search ..... 131/77, 78, 84.1, 331, 131/339, 340; 493/39, 42, 44, 46

[56] References Cited

U.S. PATENT DOCUMENTS

| | | | |
|---|---|---|---|
| 2,001,709 | 5/1935 | Davidson | 131/52 |
| 2,039,298 | 5/1936 | Davidson | 131/52 |
| 2,164,702 | 7/1939 | Davidson | 93/1 |
| 2,900,989 | 8/1959 | Davidson | 131/208 |
| 3,230,958 | 1/1966 | Dearsley | 131/8 |
| 3,396,061 | 8/1968 | Browne | 156/178 |
| 3,599,646 | 8/1971 | Berger et al. | 131/265 |
| 4,168,712 | 9/1979 | Labbe | 131/84.1 X |
| 4,537,583 | 8/1985 | Pryor | 493/42 |
| 4,661,090 | 4/1987 | Arthor | 493/42 X |
| 4,676,769 | 6/1987 | Bahr et al. | 493/42 X |

FOREIGN PATENT DOCUMENTS

| | | | |
|---|---|---|---|
| 3611134 | 1/1988 | Fed. Rep. of Germany . | |
| 933227 | 8/1963 | United Kingdom . | |
| 8402257 | 6/1984 | World Int. Prop. O. | 131/84.1 |

*Primary Examiner*—Vincent Millin
*Assistant Examiner*—Robert W. Bahr

[57] ABSTRACT

Rods for use in the manufacture of smoking products are provided using a rod making apparatus equipped with a web preforming unit. A web of sheet-like material is passed through the web preforming unit and is pleated to form a rod-like composite. The rod-like composite then is circumscribed with wrapping material to provide a rod. The web preforming unit includes an outer frustoconical tube and an inner frustoconical member. The frustoconical member is concentric to the tube, and is positioned coaxially with respect to the tube such that an annular region is formed between the outer surface of the member and the inner surface of the tube.

16 Claims, 6 Drawing Sheets

ROD MAKING APPARATUS FOR SMOKING ARTICLE MANUFACTURE

BACKGROUND OF THE INVENTION

The present invention relates to the manufacture of rods for use in the manufacture of smoking articles, and in particular t the manufacture of rods from a web of sheet-like material.

In late 1985, a series of foreign patents was granted or registered. The patents disclosed novel smoking articles capable of providing the benefits and advantages associated with cigarettes but without delivering appreciable quantities of incomplete combustion or pyrolysis products. The earliest of these patents was Liberian Pat. No. 13985/3890, issued on Sept. 13, 1985. The Liberian patent corresponds to a later published European Patent Application, Publication No. 174,645, published on Mar. 19, 1986.

Cigarette-type smoking articles described in above referenced EPO Publication No. 174,645 as well as EPO Publication No. 212,234 include a combustible fuel element and a physically separate aerosol generating means. Combustion of the fuel element provides heat for the generation of aerosol by the aerosol generating means. A mouthend piece delivers the aerosol so produced to the mouth of the user. The production of improved mouthend pieces as well as other components for such unique types of cigarettes is clearly desirable. Such types of mouthend pieces and components are described by Barnes et al in U.S. patent application No. 089,692, filed Aug. 25, 1987, which is incorporated herein by reference.

It would be highly desirable to provide an apparatus capable of efficiently and effectively manufacturing rods useful for the manufacture of smoking articles, and in particular, to cigarette-type smoking articles of the type described in the aforementioned EPO Application Publication Nos. 174,645 and 212,234.

SUMMARY OF THE INVENTION

The present invention relates to an apparatus for manufacturing rods for use in the manufacture of smoking articles. The apparatus includes (i) means for providing a web of sheet-like material, (ii) means for pleating the web and providing a rod-like composite from the pleated web, and (iii) means for receiving the rod-like composite and circumscribing the rod-like composite with wrapping material thereby forming a continuous rod. The apparatus also includes a means for subdividing the continuous rod into a plurality of rods of predetermined length.

The means for pleating the web and providing the rod-like composite therefrom can be referred to as a "web preforming apparatus." Preferably, the web preforming apparatus includes a frustoconical tube and a frustoconical member positioned within the frustoconical tube. The inner frustoconical member is concentric to and is positioned coaxially with respect to the frustoconical tube. In such a manner, an annular region is formed between the outer surface of the frustoconical member and the inner surface of the frustoconical tube.

The web preforming apparatus provides a manner or method for producing a large number of pleats of relatively controlled shape and size from a web of sheet-like material. In particular, the web is fed into the aforementioned annular region and tends to wrap around the radial portion of the inner frustoconical member. The web then tends to become pleated as the circumference of the frustoconical member decreases. The radial spacing between the frustoconical tube and the inner frustoconical member (i.e., the width of the annular region) can vary and is selected depending upon factors such as the characteristics of the web. The selection of the width of the annular region provides for control of the desired pleating pattern of the web. Maximum pleating and fill of the annular region at the exit end of the preforming apparatus is desired, while it is also desirable to allow free passage of the pleated web from the preforming apparatus. The pleated web having a rod-like shape then is directed into a rod-making unit or other such means to provide a rod from the pleated or preformed web.

As used herein, the term "frustoconical" relates to an object having generally the geometric shape of a frustrum. As used herein, the term "frustrum" relates to the geometric shape obtained when the top of a cone is removed by cutting through the cone in a plane essentially parallel to its base. As used herein, the term "cone" relates to the geometric shape obtained when a right angle triangle is rotated about one of its sides adjacent to the right angle. A cone has a pointed end or top, and a flat base.

As used herein, and only for purposes of this invention, the term "pleating" refers to the continuous folding over or doubling over of a web of sheet-like material upon itself. Pleated materials have a wavy, folded or corrugated appearance when viewed end-on; and are convoluted to the degree that the material appears folded or otherwise gathered when viewed end-on.

As used herein, by the term "sheet-like" is meant that the material is in a configuration or form wherein the width and length thereof are substantially greater than the thickness thereof. By the term "web" is meant that the material in sheet-like form is in a configuration or form wherein the longitudinally extending length thereof is substantially greater than the width thereof. Preferably, a web of sheet-like material is provided in roll form.

The apparatus of this invention is useful in manufacturing rods for mouthend pieces to be used in conjunction with the unique cigarette-type smoking articles described in the aforementioned EPO Application Publication Nos. 174,645 and 212,234. In particular, a pleated non-woven thermoplastic web component in the form of a rod can act as a heat sink to cool the mainstream aerosol and hence reduce perceived hot spots. The heat sinking nature is believed to be provided by distributing the mainstream aerosol over a large surface area, preferably over substantially the entire surface area of the mouthend piece component(s). It is believed that distribution of the mainstream aerosol over a large surface area contributes to the perceived reduction in temperature of the aerosol by increasing the residence time of the aerosol in the mouthend piece. Moreover, unlike conventional mouthend pieces which generally remove substantial amounts of various components of aerosol such as tobacco smoke, smoking articles employing a pleated non-woven web of thermoplastic material as the mouthend piece provide such perceived temperature reductions without substantial reduction in the delivery of the aerosol components (e.g., glycerin, flavor components, and the like, for those aforementioned unique cigarette-type smoking articles). In other words, the filter efficiency of such materials can be substantially lower than that of conventional cigarette filter materials such as cellulose acetate tow. As such, rods can be manufactured using the apparatus of this invention, and such rods can be employed to provide low efficiency filter elements for a wide variety of smoking articles.

DESCRIPTION OF THE PREFERRED EMBODIMENTS DETAILED

Figure 1:
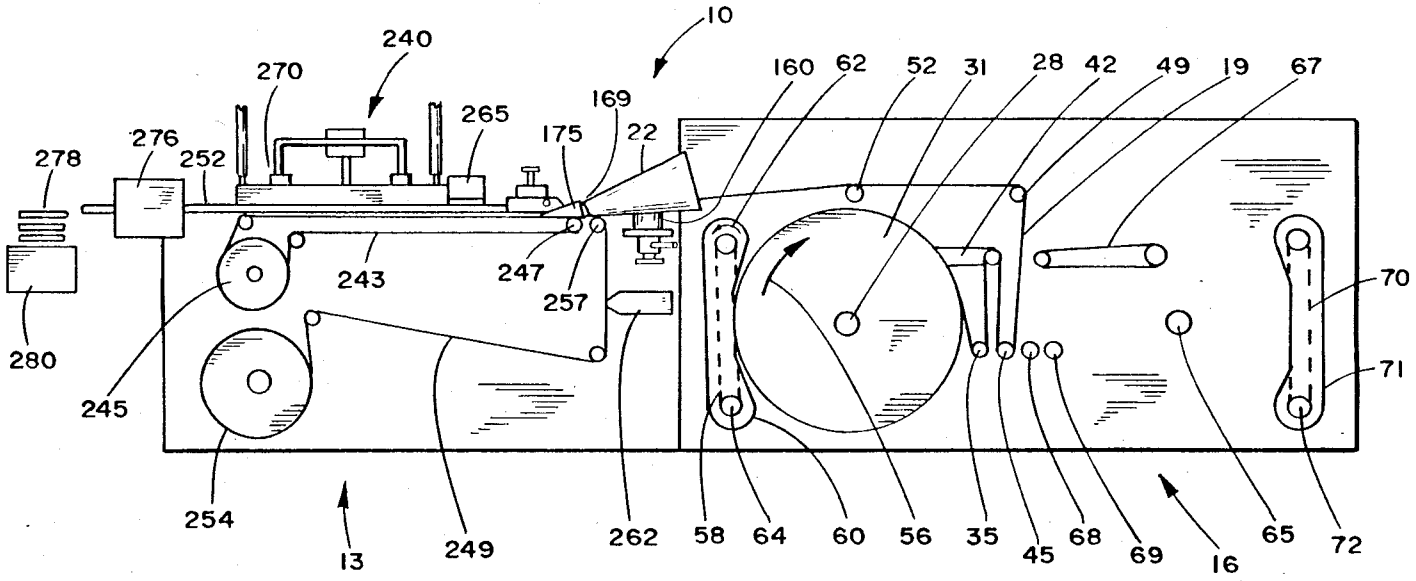
FIG. 1 is a diagrammatic illustration of a rod-making apparatus including a source of sheet-like material, a web unwind means for providing sheet at a controlled tension, the web preforming apparatus, and the rod-forming unit.

Referring to FIG. 1, rod making apparatus 10 includes a rod making unit 13, an unwind unit 16 for feeding or otherwise providing web 19, and a web preforming apparatus 22. The rod making unit 13 can vary and is preferably a conventional apparatus for making cigarette filter rods. An exemplary rod making unit 13 is a commercially available Hauni KDF 2 from Hauni-Werke Korber & Co. Kg., Hamburg, Fed. Rep. of West Germany. The manner of operation of a suitable rod making unit is known by the skilled artisan.

The unwind unit 16 for providing web 19 includes a rotatable mandrel 28 for supporting bobbin 31. The mandrel includes a chuck or other such means for gripping the internal hollow core of the bobbin. An exemplary chuck is described in U.S. Pat. No. 3,792,868. The web 19 is continuously fed from the bobbin 31 around fixed guide roller 35 and around dancer roller 38. The dancer roller is carried by a movable arm 42 thereby forming a dancer unit such that a web 19 can be fed from the bobbin 31 and obtained at a relatively constant, controlled tension. The web passes from the dancer roller 38 around fixed guide roller 45, around another fixed guide roller 49, and over yet another guide roller 52. It is convenient for guide roller 52 to be an adjustable guide roller. The web 19 then passes into the preforming apparatus 22. The combination of the mandrel 28, dancer roller 38 and guide rollers 35, 45, 49 and 52 provides a web control means for providing web at a controlled tension. Other configurations of dancer rollers and guide rollers may be apparent to the skilled artian.

Mandrel 28 allows the bobbin 31 to be rotated such as in the direction shown by arrow 56. The rotation is provided by movement of belt 58 (shown by broken lines) on drive arm 60 which supports the belt. The belt 58 moves in the direction shown by arrow 62 as a result of rotation of gear 64. Gear 64 is driven at a rate which is timed to the rate at which the drive means of the rod-making unit operates.

A representative unwind unit 16 can have the capability of being equipped with 2 bobbins such that "downtime" during the rod-making operation is minimized when one bobbin is depleated and a fresh bobbin is introduced. The unwind unit 16 includes mandrel 65 for supporting a second bobbin (not shown). The unwind unit also includes dancer roller 66 and movable arm 67 (which together form a dancer unit) as well as guide rollers 68 and 69, which correspond to previously described dancer roller 38, movable arm 42, and guide rollers 35 and 45, respectively. The unwind unit also includes belt 70 (shown by broken lines) supported by drive arm 71, and gear 72 which correspond to belt 58, drive arm 60 and gear 64, respectively.

Figure 2:
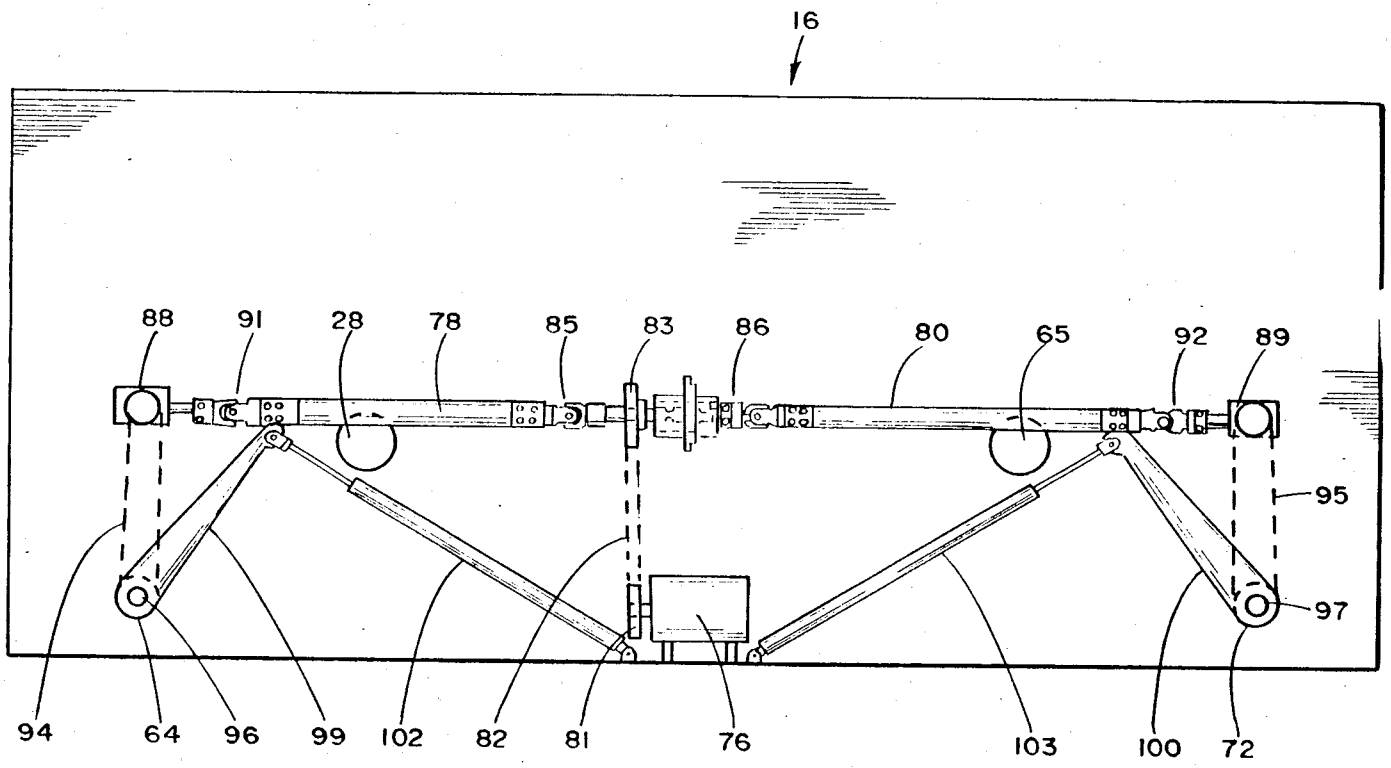
FIG. 2 is a diagrammatic illustration of the inner components of the web unwind means of the rod-making apparatus of FIG. 1.

Referring to FIG. 2, unwind unit 16 includes motor 76, the operation of which is controlled by input from a sensor (not shown) which senses the rate at which the drive shaft of the rod-making unit (not shown) operates. The operation of motor 76 also is controlled by input from a second sensor (not shown) which senses movement of the dancer arm resulting from the tension of the web leaving the bobbin. The motor 76 drives both drive shafts 78 and 80. For example, motor 76 drives pulley 81 which in turn drives belt 82 which in turn drives pulley 83. The pulley 83 in turn drives both drive shafts 78 and 80. Connection of the drive shafts 78 and 80 to the pulley 83 is accomplished using Hookes joints 85 and 86, respectively. The opposite end of each drive shaft 78 and 80 is connected to right angle gear boxes 88 and 89, respectively, using Hookes joints 91 and 92, respectively. The right angle gear boxes 88 and 89 each in turn act to drive gears 64 and 72, respectively, using respective internal belts 94 and 95. Each drive gear 64 and 72 is equipped with clutch and brake units 96 and 97, respectively. Connecting arms 99 and 100 from gears 64 and 72, respectively, provide connection to pneumatic cylinders 102 and 103, respectively. The pneumatic cylinders 102 and 103 provide a driving force for the respective movement of drive arms 60 and 71 (shown in FIG. 1). The pneumatic cylinders 102 and 103 also facilitate retraction of respective drive arms 60 and 71 (shown in FIG. 1) to enable bobbin loading.

Other suitable methods for controlling the rate of feed of web relative to the speed of operation of the rod-making unit will be apparent to the skilled artisan.

Referring to FIGS. 3 through 6, web preforming apparatus 22 includes an outer frustoconical tube 130 (shown as a sectional view) as well as an inner frustoconical member 133. Each of tube 130 and member 133 are positioned coaxially relative to one another so as to form annular space 136 between the outer region of inner member 133 and the inner region of outer tube 130.

Figure 3:
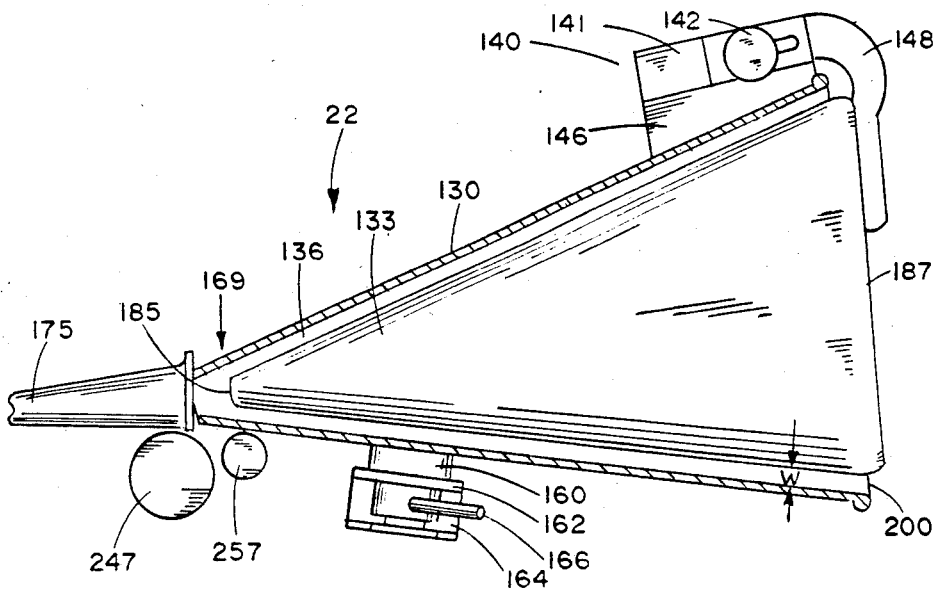
FIGS. 3 through 7 are enlarged, partial sectional views of various embodiments of the web preforming apparatus, as well as a portion of the tongue and garniture of the rod-forming unit.

As shown in FIG. 3, tube 130 and member 133 are of similar shape such that the width w of the annular region 136 remains essentially constant along the longitudinal length of the web preforming apparatus. By the term "similar" is meant that the general frustoconical shapes of the tube 130 and member 133 are essentially identical except for size.

Figure 4:
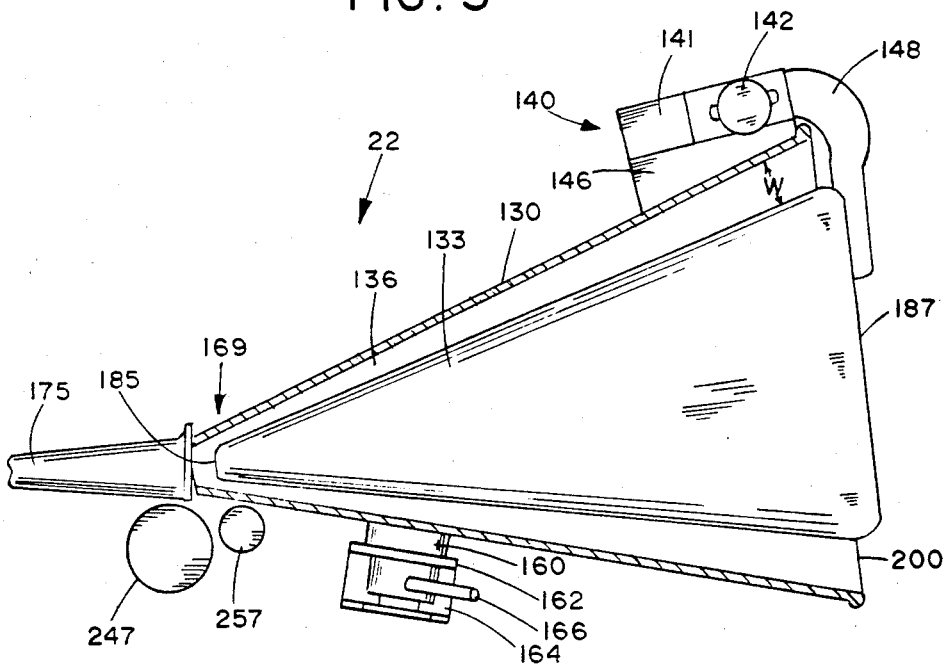

As shown in FIG. 4, the shape of tube 130 is converging relative to the shape of member 133 such that the width w of the annular region 136 gradually becomes smaller along the longitudinal length of the web preforming apparatus.

Figure 5:
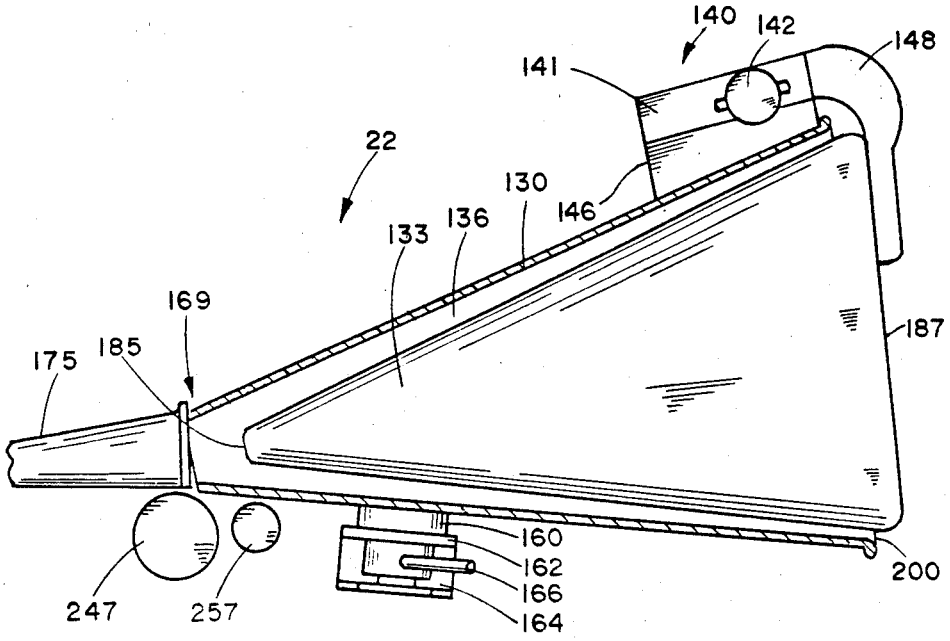

As shown in FIG. 5, the shape of tube 130 is diverging relative to the shape of member 133 such that the width w of the annular region 136 gradually becomes greater along the longitudinal length of the web preforming apparatus.

Figure 6:
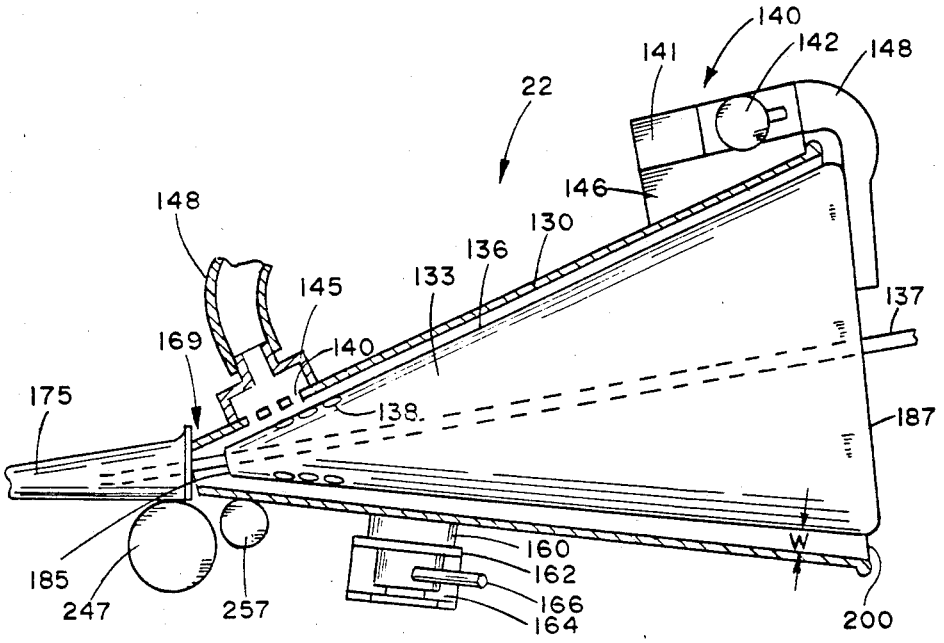

As shown in FIG. 6, the inner member 133 has a tube 137 of relatively small circumference extending longitudinally therethrough. As such, a material having a thread, strip, rod or tubular shape can be introduced into the pleated web or rod-like composite. In addition, the narrow end of the inner member can have a plurality of small openings 138 or other means for allowing airflow for reducing the frictional contact between the inner member 133 and the web which is passed through the web preforming apparatus. If desired, the narrow end of the outer member can have a plurality of small openings 140 or other means for allowing airflow for reducing frictional contact between the outer member 130 and the web which is passed through the web preforming apparatus. An annulus 145 (shown as cut away) conveniently is positioned around the small openings 140 in order to ensure that airflow provided from air line 148 (shown as cut away) passes through the openings 140. The airflow is provided conveniently from a laboratory air line or other source of airflow (not shown) through a suitably equipped tube or other airflow transfer means.

Referring again to FIGS. 3 through 6, inner member 133 and the outer tube 130 are maintained in position relative to one another by bracket 140 or other suitable connecting means. A convenient bracket means includes slidable bracket 141 which includes adjustment-/locking screw 142. The slidable bracket 141 is movable along an axis essentially parallel to that axis of each of the inner member 133 and outer tube 130. The slidable bracket 141 is movable along track 146. Track 146 conveniently can be fixedly secured to the outer surface of outer tube 130 by spot welds or other suitable means. The slidable bracket 141 is in turn connected to the inner member 133 by connecting arm 148, or other suitable connecting means. As such, the inner member 133 can be moved along its longitudinal axis such that the width w of the annular region 136 can be selected as desired.

The web preforming apparatus 22 is secured in position relative to the rod making unit. Typically, a support 160 fixedly secured to the outer tube 130 can conveniently be employed as a means for securing the web preforming apparatus to the rod making unit. The support 160 conveniently can include slide ways 162 and be movable relative to the corresponding bracket 164 of the rod forming unit. The support conveniently includes adjustment lever 166. As such, the web preforming apparatus can be moved along its longitudinal axis such that the exit region 169 of the outer tube 130 can be positioned at a variety of positions relative to tongue 175 of the rod making unit.

The outer tube 130 of the web preforming apparatus generally is cast, manufactured from stainless steel sheet, or the like. Typically, metal sheet having a thickness of about 0.02 inch to about 0.05 inch, preferably about 0.03 inch is suitable for most applications. The inner member 133 generally is manufactured from materials similar to the outer tube 130. The inner member 133 conveniently has closed end portions 185 and 187, in order that web which is being preformed is more readily directed into the annular region 136 rather than within the inner member. However, the ends of inner member 133 can be open to form a tube, if desired.

A typical web preforming apparatus includes an outer frustoconical tube having a narrow region of about 16 mm minimum inner diameter, an entrance region of about 242 mm maximum inner diameter, and an axial length of about 313 mm; and an inner member similar to the outer tube having a narrow region of about 18 mm minimum outer diameter, an entrance region of about 229 mm maximum outer diameter, and an axial length of 318 mm. Such an outer tube and inner member can be arranged concentrically such that the annular region therebetween has a width w (e.g., a radial width) of 1 mm to 10 mm, preferably about 3 mm. Typically, webs of 6 inch to 15 inch, preferably 8 inch to 12 inch width conveniently can be processed using such an exemplary web preforming apparatus.

The web preforming apparatus 22 includes web entrance region or web entry point 200, which is typically near the bottom region of the wide portion of the web preforming apparatus and opposite the bracket portion 140. Preferably, the width of the web is such that for a particular web preforming apparatus, the maximum circumference of the inner frustoconical member is greater than twice the width of the web. The web preforming apparatus 22 also includes exit region or narrow region 169. The inner member near the entrance region can be radiused or otherwise rounded to prevent tearing of the web during rod formation steps.

The web preferably enters the web preforming apparatus in a very low or an essentially tension free state. By this is meant that the web is in a condition whereby it is not stretched along its length to any appreciable degree at the point which it enters the preforming apparatus. As such, the web tends to wrap around the radial portion of the inner member as it passes through the preforming apparatus. However, the pleating of the web is believed to occur due to a substantial increase in the tension experienced by the web near the narrow (i.e., output) end of the inner frustoconical member.

Figure 7:
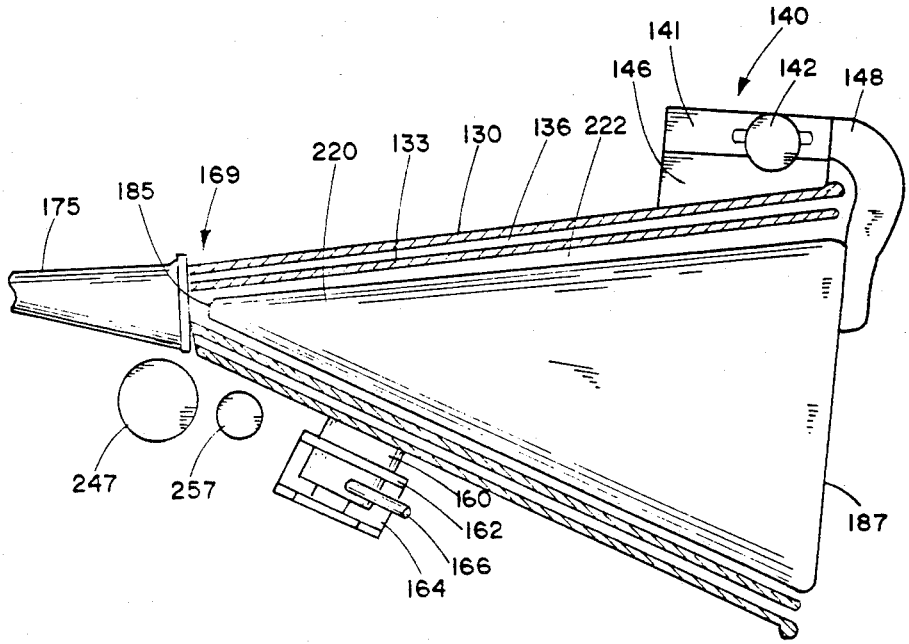

An alternate embodiment of a web preforming apparatus is shown in FIG. 7. The web preforming apparatus 22 includes an outer frustoconical tube 130 and an inner frustoconical tube 133 (both shown as a sectional view). A further inner frustoconical member 220 is positioned coaxially relative to each of tubes 130 and 133 so that an annular space 136 is formed between the inner region of outer tube 130 and the outer region of inner tube 136; and an annular space 222 is formed between the inner region of inner tube 136 and the outer region of inner member 220. As such, two independent webs can be simultaneously fed into each of annular regions 136 and 222 (using two suitable equipped web unwind units) in order to provide pleating of each of the webs for formation of a rod. As such, rods having two types of pleated sheet-like materials can be manufactured. In particular, the pleated web passing through outer annular region 136 exits the preforming apparatus and envelops the pleated web which exits the preforming apparatus through inner annular region 222 in such a manner as to form a continuous rod.

Referring again to FIG. 1, the narrow exit region of the web preforming apparatus is positioned relative to tongue 175 or other such gathering means such that the web which has been pleated and formed into a rod-like composite (not shown) can be received into the rod-forming unit 13. That is, the pleated web has a generally cylindrical shape. The pleated web which exits the narrow region 169 of the web preforming apparatus as a rod-like composite is fed into wrapping mechanism 240 which includes an endless garniture conveyor belt 243. The endless garniture conveyor belt is continuously and longitudinally advanced using advancing mechanism 245. Roller 247 provides a means for guiding the garniture conveyor belt under the tongue 175 of the rod forming unit. The wrapping mechanism introduces a web of wrapping material 249 to the outer surface of the cylindrical composite to produce a continuous rod 252. Typically, the web of wrapping material is provided from bobbin 254. Roller 257 provides a means for guiding the web of wrapping material into the garniture.

The endless garniture conveyor belt transports the web of wrap 249 and cylindrical composite in a longitudinally extending manner through the wrapping mechanism 240 while draping or enveloping the wrapping material about the cylindrical composite. The seam formed by an overlapping marginal portion of the wrapping material has adhesive (e.g., hot melt adhesive) applied thereto by applicator 262. The hot melt adhesive is reactivated in reactivating region 265 in order that the wrapping material can form a tubular container for the cylindrical composite. The adhesive can be cooled using chill bar 270 in order to cause rapid setting of the adhesive. Other means for securing or sealing the wrapping material can be employed in providing the continuous rod.

The continuous rod 252 passes from the sealing means and is subdivided (e.g., severed) at regular intervals at the desired, predetermined length using cutting means 276. The succession or plurality of rods 278 are collected for use in collection means 280 such as a tray, collection drum or the like.

The web can vary. The web can be a natural material such as reconstituted tobacco material, or a synthetic material such as thermoplastic polymer material. While most thermoplastic polymers may be used in preparing the web material, the preferred thermoplastic polymers are polyolefins such as isotactic polypropylene, and polyesters such as poly (butylene terephthalate). Due to the nature of the meltblown thermoforming process, various additives (e.g., calcium carbonate) can be easily incorporated internally in the polymer melt or blown onto the molten polymer surface as it is extruded in order to change the structure of the meltblown web and thus its performance in a smoking article filter element. Also, meltblown webs, after formation, are easily subject to known post treatments with auxiliary agents in dry or liquid form to provide certain organoleptic and/or medicinal attributes.

The width of the web of sheet-like material can vary, and typically is a width capable of being pleated to form the rod. The total width of the strip employed in providing a desired rod can depend upon factors such as the thickness of the sheet-like material, the number of pleats desired, the nature or character of the pleats produced, the surface character of the material (i.e., a fibrous surface character versus a smooth surface), the porosity of the material, the moisture content of the material, the lubricity properties of the material, the friction characteristics of the web preforming apparatus relative to the sheet-like material, and other such factors.

Preferred sheet-like materials are thin, and have reasonably high tensile strengths, resiliencies and relatively good flexibilities. In particular, it is desirable that the web have a good "hand" to hold a fold but not tear, crinkle, shatter or otherwise break during the folding or pleating process. It is desirable that the modulus of the web be such that pleating readily occurs. In particular, the web should not be so hard that it does not pleat; nor should the web be so soft that overly soft (i.e., not firm) rods of poor resiliencies are provided. As such, the rod-like composite of pleated web can be provided at a high speed and easily enclosed within the outer wrapping material.

Figure 8:
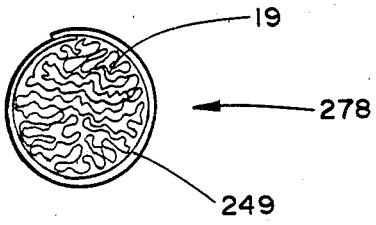
FIGS. 8 through 10 are enlarged end views of rods which are provided using the apparatus of this invention.
Figure 9:
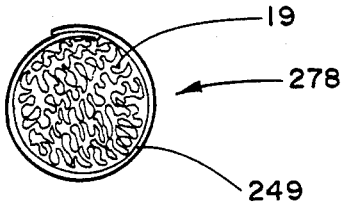
Figure 10:
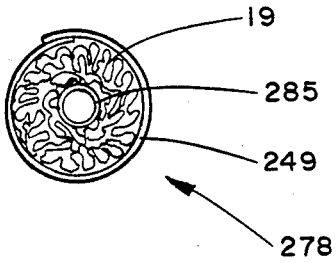

Referring to FIGS. 8 through 10, rod 278 has a substantially cylindrical shape and a generally circular cross sectioned shape. Preferably, the ends of the rod each form a plane perpendicular to the longitudinal axis thereof. The rod most preferably includes a plurality of longitudinally extending pleats in the web of sheet-like material 19. The pleated web is contained in a wrapping material 249 such as cigarette paper wrap or paper plug wrap which is formed in a tubular shape around the pleats. The rod shown in FIG. 10 has a tube 285 extending longitudinally therethrough.

Typical rod sizes range in length from about 80 mm to about 130 mm, and from about 16 mm to about 28 mm in circumference. A typical rod shown in FIG. 8, having web 19 of reconstituted tobacco material, and having a 80 mm length and 24.5 mm circumference exhibits a pressure drop of from about 20 mm to about 40 mm of water as determined at an airflow rate of 17.5 cc/sec using an encapsulated pressure drop tester, sold commercially as Model No. FTS-300 by Filtrona Corporation. The pressure drop of a typical rod can be controlled from very low to quite high depending upon factors such as the width of the web which is pleated, the characteristics of the material which is pleated, and the like.

Typical rods exhibit good firmness and good integrity. In particular, it is desirable that the pleated web not readily fall out of the ends of the rod. The rods exhibit a firmness value of less than 10 units, preferably less than 5 units, characteristic of a cylindrical rod shaped element having a circumference of about 24.5 mm as measured at 76° F. and 60 percent relative humidity using a Cigarette Firmness Tester Model No. CFTA supplied by Fairchild Industries, Winston-Salem, N.C. As such, there can be provided surprisingly firm rods from a relatively low quantity of sheet-like material, and the rods so provided can have a relatively large number of air passageways extending longitudinally therethrough.

The following examples are provided in order to further illustrate the invention but should not be construed as limiting the scope thereof. Unless otherwise noted, all parts and percentages are by weight.

EXAMPLE 1

An apparatus as previously described and generally as shown in FIGS. 1, 2 and 3 are provided. The web preforming apparatus includes an outer tube having a circular cross sectional shape and manufactured from stainless steel of 0.03 inch thickness. The tube has a narrow region of 16 mm minimum inner diameter, an entrance region of 242 mm maximum inner diameter, and an axial length of 313 mm. The inner member has closed ends, has a circular cross sectional shape, and is manufactured from stainless steel sheet of 0.03 inch thickness. The inner member has a narrow region of 18 mm minimum outer diameter, an entrance region of 229 mm maximum outer diameter, and an axial length of 318 mm. The tube and the member are essentially similar in that the nominally included angle of the tube is about 40°, while the nominally included angle of the member is about 38°. The outer funnel and inner member are arranged concentrically and coaxially such that the annular region therebetween has a width of about 3 mm.

The web (described in greater detail hereinafter) is fed into the annular region between the outer funnel and inner member. The web preforming apparatus is positioned such that the longitudinal axis thereof is at about a 15° angle relative to the longitudinal axis of the tongue and garniture conveyor belt of the rod-making unit.

A web of an experimental meltblown, macrofiber, polypropylene material designated as PP-100-F is obtained from Kimberly-Clark Corporation. The web has glycerin incorporated therein at about a 2 percent level in order to improve the processability of the material. The web has a width of about 11.75 inch and a basis weight of about 0.75 ounce per square yard.

The web is fed from a bobbin supported on a web control unit, fed through the web preforming apparatus in the lower region thereof opposite the bracket which holds the frustoconical tube and frustoconical member in place relative to one another. The web then is formed into a rod using a KDF-2 rod-making unit. About 2,000 rods of 120 mm length are made in a 1 minute period. The outer wrapper is provided by paper plug wrap available as P-1487-184-2 from Kimberly-Clark Corp. The rods so provided have a circumference of 24.10 mm.

The rods have a pleated pattern when viewed end-on. A representative pleated pattern is shown in FIG. 9. The rods have a pressure drop of about 90 mm to about 120 mm of water pressure drop as measured using a Filtrona Model No. FTS-300 pressure drop tester.

EXAMPLE 2

The apparatus described in Example 1 is used to manufacture rods using a web of tobacco-containing paper. The paper is reconstituted tobacco material obtained from Kimberly Clark Corporation as P144-185-GAPF Reconstituted Tobacco Sheet.

The material includes about 60 percent tobacco principally in the form of flue-cured/burley tobacco stems and 35 percent soft wood pulp (based on dry weight of the material). The moisture content of the sheet-like material preferably is between about 11 and 14 percent. The material has a dry tensile strength of about 1,600 to about 3,300 gm/inch, and a dry basis weight of about 38 to about 44 g/sq. meter. The material is manufactured using a conventional papermaking-type process including the addition of about 2 percent glycerin or other humectant, about 1.8 percent potassium carbonate, about 0.1 percent flavorants and about 1 percent of a commercial sizing agent. The sizing agent is commercially available as Aquapel 360XC Reactive Size from Hercules Corp., Wilmington, Del. The width of the web is about 8.5 inches.

The rods have a pleated pattern when viewed end-on. A representative pleated pattern is shown in FIG. 8. The rods have a length of about 120 mm and a pressure drop of about 100 mm water pressure drop as measured using a Filtrona Model No. FTS-300 pressure drop tester.

EXAMPLE 3

An apparatus as previously described and generally as shown in FIGS. 1, 2 and 6 is provided. The web preforming apparatus includes an outer tube manufactured from stainless steel of 0.03 inch thickness. The tube has a narrow region of 16 mm inner diameter, an entrance region of 242 mm maximum inner diameter, and an axial length of 313 mm. The inner member has closed ends, and is manufactured from stainless steel sheet of 0.03 inch thickness. The inner member has a narrow region of 18 mm outer diameter, an entrance region of 229 mm maximum outer diameter, and an axial length of 318 mm. The outer funnel and inner member are arranged concentrically and coaxially such that the annular region therebetween has a width of about 3 mm. The web preforming apparatus is positioned at about a 15° angle relative to the longitudinal axis of the tongue and garniture conveyor belt of the rod-making unit. The web preforming apparatus includes a cylindrical metal tube of 0.156 inch inner diameter and 0.25 inch outer diameter extending through the inner member, and extending about 3 inches beyond the narrow end of the inner member.

A web of tobacco-containing paper described in Example 2 is used to manufacture rods. However, as the web is passed through the web preforming unit, a tube of polyethylene having an outer diameter of about 4 mm and an inner diameter of about 3.5 mm is fed from a bobbin and through the previously described narrow tube which extends through the inner member.

The rods have a pleated pattern when viewed end-on and a tube passing longitudinally therethrough. A representative end view of a rod is shown in FIG. 10.

What is claimed is:

1. An apparatus for manufacturing rods for use in the manufacture of smoking articles, the apparatus including:

(a) means for providing a web of sheet-like material;

(b) means for pleating the web and providing a rod-like composite from the pleated web, such means including a frustoconical tube and a frustoconical member concentric to the tube and positioned with respect to the tube such that (i) an annular region is formed between the outer surface of the frustoconical member and the inner surface of the frustoconical tube, and (ii) the web is fed through the annular region; and (c) means for receiving the rod-like composite and circumscribing the rod-like composite with wrapping material thereby forming a rod.

2. The apparatus of claim 1 wherein the frustoconical member is a frustoconical tube.

3. The apparatus of claim 1 wherein the shape of the frustoconical tube is similar to the shape of the frustoconical member.

4. The apparatus of claim 1, 2 or 3 including (i) means for circumscribing the rod-like composite with wrapping material thereby forming a continuous rod, and (ii) means for subdividing the continuous rod into a plurality of rods.

5. The apparatus of claim 1 wherein the shape of the frustoconical tube is diverging relative to the shape of the frustoconical member.

6. The apparatus of claim 1 wherein the shape of the frustoconical tube is converging relative to the shape of the frustoconical member.

7. The apparatus of claim 1 or 3 wherein the width of the annular region is in the range of from 1 mm to 10 mm.

8. The apparatus of claim 3 wherein the width of the annular region is about 3 mm.

9. The apparatus of claim 1 or 3 wherein the inner member has an essentially cylindrical shaped tube extending longitudinally therethrough.

10. The apparatus of claim 1 wherein the means for pleating the web includes a web entry point for feeding the web into the annular region between the frustoconical member and the frustoconical tube.

11. The apparatus of claim 1 wherein the maximum circumference of the inner frustoconical member is greater than twice the width of the web provided by the web providing means.

12. An apparatus for manufacturing rods for use in the manufacture of smoking articles, the apparatus comprising:

(a) means for providing a first web of sheet-like material;

(b) means for providing a second web of sheet-like material;

(c) means for pleating the webs and providing a rod-like composite from the pleated webs, such means including:

(i) a first frustoconical tube and a second frustoconical tube concentric to the first tube and positioned coaxially with respect to the first tube such that an annular region is formed between the outer surface of the second tube and the inner surface of the first tube, and (ii) a frustoconical member concentric to the second tube and positioned coaxially with respect to the second tube such that an annular region is formed between the outer surface of the frustoconical member and the inner surface of the second tube; and (d) means for receiving the rod-like composite and circumscribing the rod-like composite with wrapping material thereby forming a rod.

13. The apparatus of claim 12 wherein the shape of the first frustoconical tube is similar to the shape of the second frustoconical tube and the frustoconical member.

14. The apparatus of claim 12 wherein the first pleated web exits the annular region between the first and second frustoconical tubes to envelop the second pleated web which exits the annular region between the second tube and the frustoconical member.

15. The apparatus of claim 13 wherein the first pleated web exits the annular region between the first and second frustoconical tubes to envelop the second pleated web which exits the annular region between the second tube and the frustoconical member.

16. The apparatus of claim 12, 13, 14 or 15 including (i) means for circumscribing the rod-like composite with wrapping material thereby forming a continuous rod, and (ii) means for subdividing the continuous rod into a plurality of rods.

* * * * *

UNITED STATES PATENT AND TRADEMARK OFFICE

CERTIFICATE OF CORRECTION

PATENT NO. : 4,807,809

DATED : February 28, 1989

INVENTOR(S) : Pryor et al

It is certified that error appears in the above—identified patent and that said Letters Patent is hereby corrected as shown below:

Column 1, line 3, please delete "t" and insert --to--.

Column 10, line 33, after the word "positioned" please insert --coaxially--.

Signed and Sealed this

Twenty-fourth Day of July, 1990

*Attest:*

HARRY F. MANBECK, JR.

*Attesting Officer*

*Commissioner of Patents and Trademarks*